US006135277A

United States Patent [19]

Armstrong

[11] Patent Number: 6,135,277

[45] Date of Patent: Oct. 24, 2000

[54] VACUUM RESEALABLE DISPLAY/STORAGE CASE

[76] Inventor: Timonthy Duke Armstrong, 9812 Emerson Ave. S., Bloomington, Minn. 55431

[21] Appl. No.: 09/403,135

[22] PCT Filed: Apr. 10, 1998

[86] PCT No.: PCT/US98/07222

§ 371 Date: Oct. 14, 1999

§ 102(e) Date: Oct. 14, 1999

[87] PCT Pub. No.: WO98/46499

PCT Pub. Date: Oct. 22, 1998

Related U.S. Application Data

[63] Continuation-in-part of application No. 08/840,842, Apr. 17, 1997, abandoned.

[51] Int. Cl.[7] ..... A45C 11/00; B65D 85/00

[52] U.S. Cl. ..... 206/314; 206/45.24; 206/317; 206/523; 206/524.8

[58] Field of Search ..... 206/204, 205, 206/45.24, 314, 317, 315.1, 315.11, 521, 523, 524.8, 579, 736, 829; 190/18 R; 99/472, 467, 646 C

[56] References Cited

U.S. PATENT DOCUMENTS

| | | | |
|---|---|---|---|
| 1,772,308 | 8/1930 | Ezzelle . | |
| 4,049,091 | 9/1977 | Chubb . | |
| 4,106,597 | 8/1978 | Shook et al. | 206/523 |
| 4,117,875 | 10/1978 | Hickeky . | |
| 4,147,254 | 4/1979 | Bruce . | |
| 4,320,829 | 3/1982 | DiMarzio et al. . | |
| 4,362,095 | 12/1982 | Wheatley . | |
| 4,378,881 | 4/1983 | De Vries . | |
| 4,465,189 | 8/1984 | Malzon . | |
| 4,531,632 | 7/1985 | Weber . | |
| 4,632,241 | 12/1986 | Brough et al. . | |
| 4,730,726 | 3/1988 | Holzwarth . | |
| 5,333,736 | 8/1994 | Kawamura | 206/524.8 |
| 5,407,155 | 4/1995 | Chung . | |
| 5,419,450 | 5/1995 | Guglielmelli . | |
| 5,485,921 | 1/1996 | Tolendano . | |
| 5,547,079 | 8/1996 | Pino | 206/317 |
| 5,570,628 | 11/1996 | Kiener et al. . | |
| 5,644,899 | 7/1997 | Truesdale | 206/204 |
| 5,788,078 | 8/1998 | Fuss | 206/521 |
| 5,934,773 | 8/1999 | Ferrell | 206/204 |

FOREIGN PATENT DOCUMENTS

| | | |
|---|---|---|
| 274928 | 7/1997 | France . |
| 26 42 070 | 3/1978 | Germany . |
| 94 04 100 U | 5/1994 | Germany . |

*Primary Examiner*—Luan K. Bui
*Attorney, Agent, or Firm*—Clayton R. Johnson

[57] ABSTRACT

A portable airtight inner case (W, Z) includes a receptacle (121) for having an item stored therein, for example a guitar (105), a hingedly mounted cover (11, 111) and a perimetric seal (39) to form a fluid seal between the cover (11, 111) and receptacle (121) when the cover is closed. The inner case cover and receptacle are made of a clear rigid plastic. A suction valve or pump (50, 130) opens to the inner case interior to evacuate fluid while a vacuum gauge (53) is provided for measuring the pressure. The inner case bottom wall (32, 117) has a plurality of pockets (74, 148) for having hangers extended therein to hang the case on a wall and stand pockets (142) to have stand parts of a foldable stand (85) extended therein or a stand (144) pivoted to the bottom wall to support the inner case (W, Z) in an inclined condition. A portable outer case (X, 170) has a compartment for containing the inner case.

18 Claims, 10 Drawing Sheets

VACUUM RESEALABLE DISPLAY/STORAGE CASE

RELATED APPLICATION

This application is a continuation-in-part of U.S. application Ser. No. 08/840,842, filed Apr. 17, 1997, abandoned.

BACKGROUND OF THE INVENTION (1) Field of the Invention

This invention relates to portable cases that may be carried by an individual for storing and transporting various items, for example musical instruments such as guitars, or guns or collectibles, for example artwork.

(2) Description of the Prior Art

Many individuals collect vintage musical instruments, for example guitars that are 20 years of age or more and some instruments have appreciated over the years to an extent that they may be worth $100,000 or more. The original cases were relatively inexpensive, for example made of chipboard or cardboard type material, and have long since worn out or deteriorated. Replacement cases know to applicant are not clear (transparent) or as strong as desired. Further when such collectibles are taken to shows, the guitars are taken out of the case and supported on tables or the floor, by for example, a generally U-shaped frame for supporting the base of the guitar and another that supports the neck. If on a table and the table is bumped, the guitar can fall and possibly be damaged. Also, the instruments can be readily touched by individuals which, in many situations, is undesirable. Also, in music stores, musical instruments such as guitars are displayed by generally U-shaped hangers to support the instrument in depending relationship to the hanger with the instrument tuners or head stock abutting against the hanger. Additionally, with presently available portable instrument cases or other cases known to applicant, the instruments or other collectibles stored therein are subject to more adverse humidity and other ambient air conditions than desirable.

In order to provide portable storage cases to overcome problems such as mentioned above and which may be carried by an individual, and additionally that may be used as a display case, this invention has been made.

SUMMARY OF THE INVENTION

An outer case has a compartment for carrying an inner case made of plastic in which a valuable item may be stored and displayed. Further, the cases are of a type that may be readily carried by an individual from one location to another. The inner case has a cover and a receptacle with the receptacle being provided with a plurality of outwardly opening cavities which do not open into the interior of the inner case. Some of the cavities are provided to have hangers extended thereinto to support the inner case in hanging relationship to a support, for example, on a wall. Other cavities may be provided to have portions of a stand extend thereinto to support the inner case on a floor and extend thereabove in an inclined condition while in another embodiment a stand is pivoted to the inner case bottom wall. Mounted to or contained in the inner case is one or more of a vacuum gauge, a vacuum valve or a vacuum pump to facilitate withdrawing fluid from within the closed inner case and thereby reduce deterioration of the item in the case and a vent valve. Also, there may mounted to or provided in the inner case, one or more of appropriate sensors to determine temperature, pressure and humidity in the inner case and a conventional motion sensing alarm. Further, there advantageously is provide a removable foam insert in the inner case that has a storage chamber to have the instrument or other collectible stored therein. The inner case is made of a plastic that is clear and rigid.

One of the objects of this invention is to provide a new and novel portable case for storing valuable items and which selectively, even in a closed condition, may be easily used as a display case. In furtherance of the above object, it is another object of this invention to provide means for facilitating reducing air pressure in the case to minimize deterioration of the item in the case.

Still another object of this invention is to provide a new and novel portable case suitable for both storing a valuable item and displaying the item while maintaining the interior of the cases under a negative pressure. In furtherance of the last mentioned object, it is another object of this invention to provide a second case for carrying the portable case together with a stand for supporting the portable case in an inclined condition and pump means for reducing the pressure within the portable case below atmospheric pressure. Another object of this invention is to provide a portable case for storing valuable items with a vacuum pump attached thereto to extend into the case interior and a foam insert with a chamber to have the item placed therein and have the pump extend between the insert and the case bottom wall. In furtherance of the last mentioned object, it is a still further object of this invention to removable mount the insert in the case and to provide the chamber of a shape in plan view that generally is of the same shape in plan view as the item to be stored therein.

DETAILED DESCRIPTION OF THE INVENTION

Figure 1:
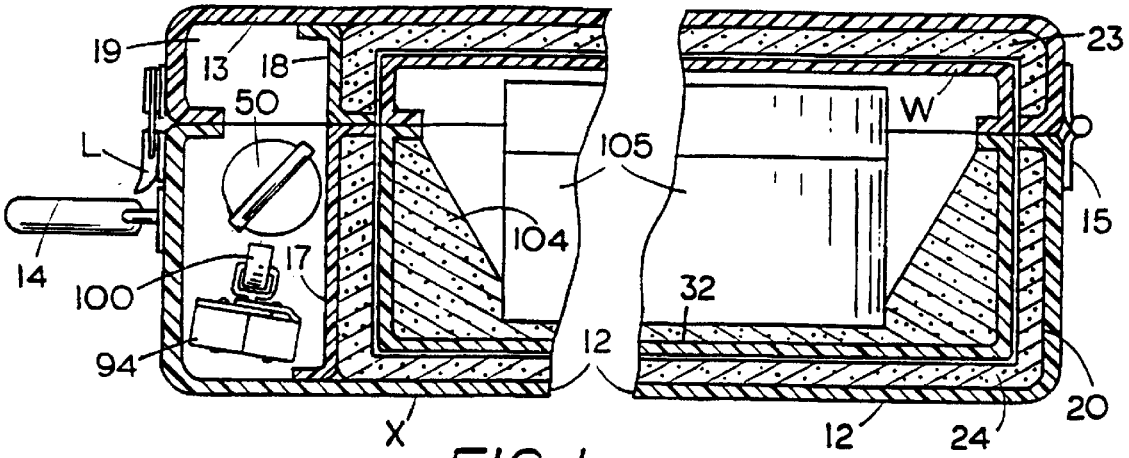
FIG. 1 is a transverse cross sectional view of the outer case with the first embodiment of the display/storage inner case of this invention therein and a guitar in the inner case, both of the cases being in a closed latched condition.
Figure 1A:
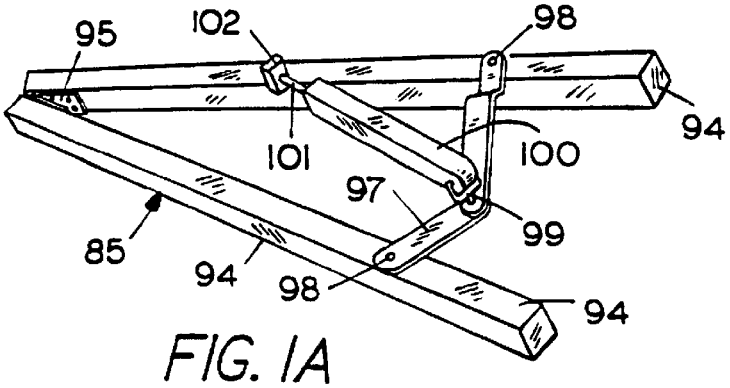
FIG. 1A is perspective view of the stand in a partially folded condition that may be utilized with the inner case of the first embodiment to support the inner case in an inclined condition.
Figure 2:
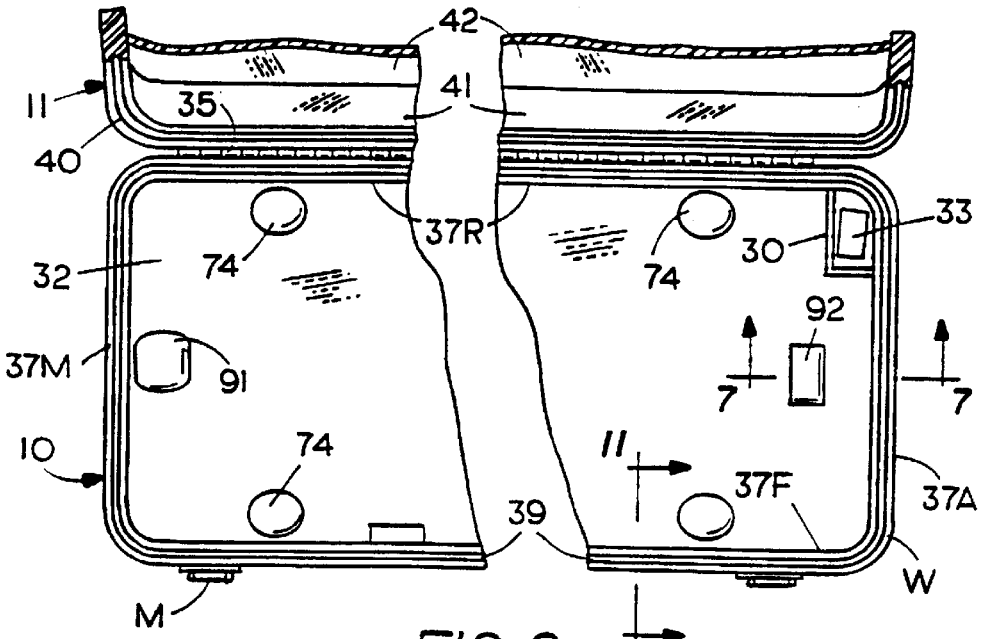
FIG. 2 is top view of the first embodiment of the inner case with its cover in an open condition.
Figure 3:
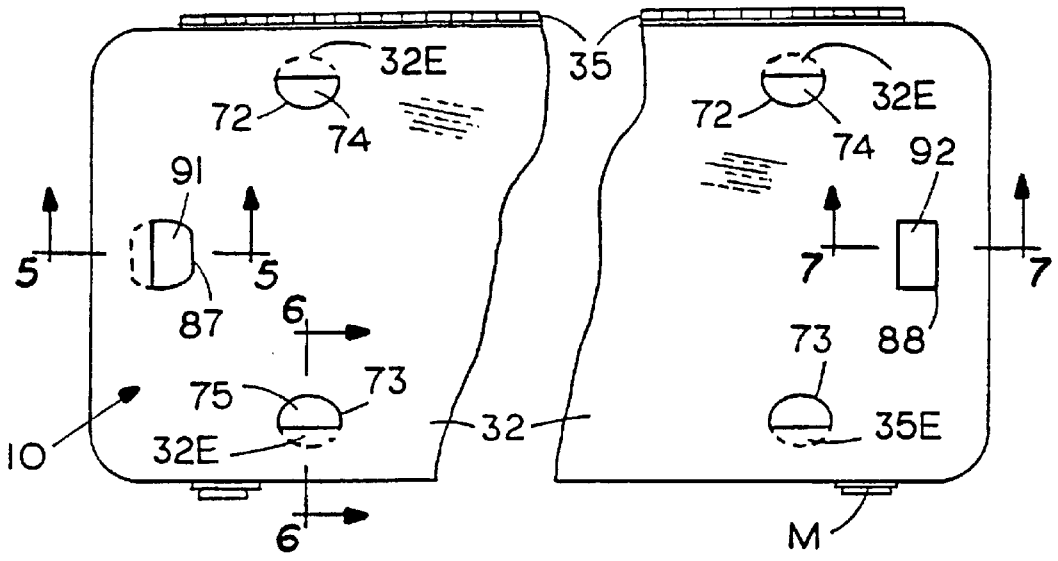
FIG. 3 is a bottom view of the inner case of the first embodiment with the longitudinal intermediate portion broken away.
Figure 4:
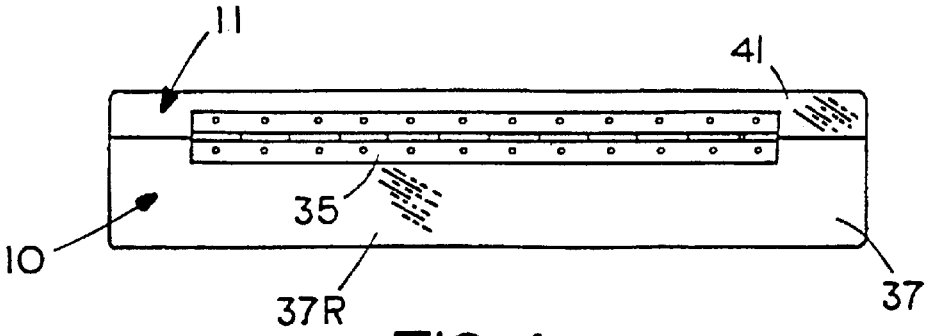
FIG. 4 is a back view of the inner case of the first embodiment in a closed condition.
Figure 4A:
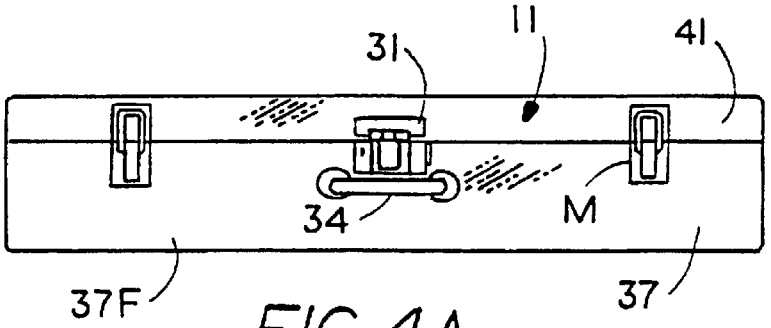
FIG. 4A is a front view of the inner case of the first embodiment in a closed latched condition.
Figure 13:
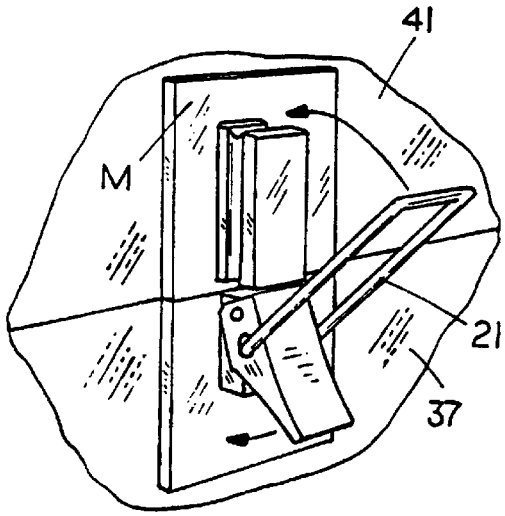
FIG. 13 is a fragmentary perspective view of one of the latch devices.

Referring in particular to FIGS. 1 and 2, the first embodiment of the invention includes a portable outer case X for transporting a portable inner case W from one location to another. Advantageously each of the outer cases in a closed condition are of generally rectangular box shaped configuration, although the case may be of other shapes, depending upon the shape of the item being stored. The outer case includes an outer receptacle 12 with a cover 13 connected thereto by hinges 15 for enclosing the receptacle. A handle 14 is connected to the outer receptacle 12 to facilitate an individual carrying the outer case while latch mechanism L is provided for releasably retaining the outer case in a closed position. The latch mechanism may be of a conventional type such as illustrated in FIG. 13 wherein the latch bail 21 is being moved to an inner case latch condition.

Dividers 17, 18 are joined to the outer receptacle and cover 13 respectively to provide a main compartment 20 and a secondary compartment 19 within the outer case. Suitably shaped plastic foam cushion members (inserts) 23, 24 may be provided in the main compartment and attached to the cover 13 and the outer receptacle respectively to, in the outer case closed position, limit relative movement, if any of the inner case, including cushioning the inner case in the outer case.

The inner case W includes an inner receptacle, generally designated 10, providing an interior compartment with a cover, generally designated 11, connected thereto by hinges 35 for closing the inner receptacle compartment. The inner case with the item to stored therein is of a weight to be carried by an individual. The inner case is made of a clear plastic to facilitate its use as a display case whereby one may easily see the object therein without having to open the case. The plastic is of sufficient rigidity that the inner case will maintain its shape even when the pressure within the inner case is substantially reduced below atmospheric pressure. Advantageously, the inner case may be made of a plastic such as vacu form polycarbonate.

A handle 34 is connected to the front wall portion 37F of the perimetric wall 37 of the inner receptacle 10 for facilitating one individual carrying the inner case while latch mechanism M is provided for releasably retaining the inner case in a closed position. The receptacle 10 includes a bottom wall 32 joined to the lower edge of the perimetric wall 37 while the upper edge portion of the perimetric wall 37 has a perimetric terminal edge portion with a perimetric groove 38 mounting a perimetric resilient seal (gasket) 39. The seal 39 is mounted to extend into perimetric groove 40 in the perimetric wall 41 of the cover 11 to prevent leakage of fluid into the inner case when the inner case is in a closed latched condition with the pressure within the inner case being substantially below atmospheric pressure.

Figure 9:
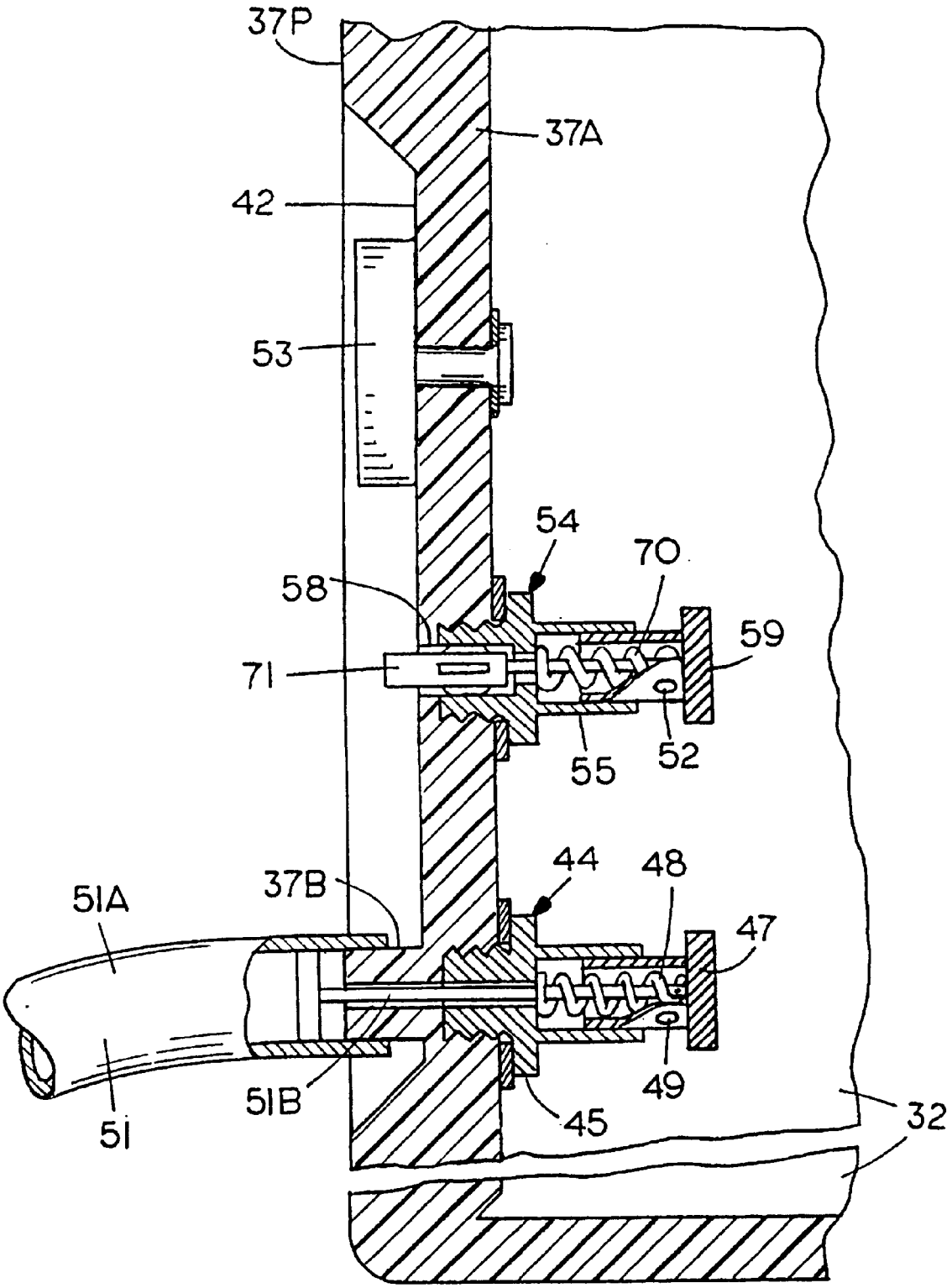
FIG. 9 is a fragmentary horizontal cross sectional view showing the vacuum gauge, vacuum vent and vacuum valve mounted to the inner case of the first embodiment, said view being generally taken along the line and in the direction of the arrows 9—9 of FIG. 8 with an intermediate portion broken away.

Referring to FIG. 9, for evacuating fluid from the inner case in its closed condition, a suction valve, generally designated 44, is mounted to the side wall portion 37A of the perimetric wall 37 to open through a boss 37B to the ambient atmosphere and to the interior of the inner case. As one example of a suitable valve, the valve may include an annular valve body 45 mounted to wall portion 37A in fluid sealing relationship. A valve member 47 is slidably extended into the valve body bore and resiliently retained in a valve closed position by a coil spring 48 whereby the valve member aperture 49 is blocked by opening to the valve body to prevent fluid flow through the valve, even when the pressure in the inner case is negative. When fluid is evacuated from the interior of the inner case, atmospheric pressure acting on the inner case results in the gasket being further compressed to enhance the fluid seal between the cover and inner receptacle.

A divider 30 is provided in the inner case to cooperate with the perimetric wall 37 to provide a compartment for having a packet of conventional desiccant 33 placed therein for reducing moisture in the inner case, wall 37 having side wall portions 37A, 37M.

For evacuating fluid from the inner case, a hand vacuum pump 50, which advantageously is of a manually operated type that may be stored in the outer case compartment 19, has its hose 51 removably mountable to the boss 37B, for example, by being threaded thereto. The inlet end portion 51A of the hose mounts a needle member 51B in fixed relationship to the hose for being extending through the boss 37B and suction valve body to push and retain the valve member 47 in an open position of FIG. 9 wherein aperture 49 is no longer blocked by the valve body. As the hose is removed from the boss, the needle member is withdrawn and the valve member 47 moves to its closed position. The inner case may be provided with suitable flanges and/or ribs (not shown) to strengthen the inner case against collapse when vacuumized.

Also mounted to the wall portion 37A is a conventional vacuum gauge 53 for providing a reading of the pressure inside of the inner case whereby the party withdrawing fluid from the inner case can ascertain that the pressure within the inner case is not reduced below a level where there is a danger of the inner case collapsing. Further, a vent valve, generally designated 54, is mounted to wall portion 37A to selectively allow ambient air from the ambient atmosphere to flow into the vacuumized inner case to equalize the pressure in and exterior of the inner case. The vent valve 54 includes an annular vent body 55 mounted to the wall portion 37A in fluid sealing relationship thereto and open through a wall aperture 58 to the ambient atmosphere. A vent closure 59 is slidably extended into the vent body bore and resiliently retained in a vent closed position by a coil spring 70 whereby the vent closure aperture 52 is blocked by opening to the vent body to prevent fluid flow though the vent, even when the pressure in the inner cas is negative. A vent stem 71 is joined to the vent closure and extended outwardly through the aperture 58 whereby, when manually pushed inwardly toward the inner case interior, the vent closure is moved to its open position against the action of spring 70 to position the aperture 52 to open to the interior of the inner case.

Advantageously, the inner case wall portion 37A has an outwardly opening recess 42 into which the valves and vacuum gauge extend, but do not extend outwardly of the exterior planar surface portion 37P of wall portion 37A whereby surface portion 37P may abut against a floor in flat relationship without any one of the valves and vacuum gauges abutting against the floor.

To facilitate utilizing the inner case as a display case whereby it may be hung from a support member 78, longitudinally spaced apertures 72 are provided in the bottom wall adjacent to the rear wall portion 37R of the perimetric wall 37 to open to cavities 77 that are defined by bottom wall bubbles 74, adjacent to generally planar portions of the bottom wall and the perimetric wall 37 which constitute hanger pockets. Likewise, forming two additional hanger pockets, there are longitudinally spaced apertures 73 in the bottom wall adjacent to the front wall portion 37F of the perimetric wall 37 to open to cavities 77 that are defined by bottom wall bubbles 74, the adjacent planar bottom wall portions and the perimetric wall 37. To facilitate hanging the inner case on the support member, for example a wall, the cavities are in part enclosed by bottom wall lip portions 32E whereby hangers 79 can extend through the appropriate set of apertures 72 and 73 to extend into the cavities 77 with the lips abutting against the hangers to limit the movement of the then upper portion of the inner case away from support member 78 with the then lower case portion abutting against the support member. Advantageously, the interior surface of the bottom wall of the inner case, other than for the bubbles, may be generally planar and parallel to the interior surface of the top wall 42 of the cover 11 in a closed condition.

Alternately, when using the inner case as a display case in an inclined condition on a floor or the like, there is provide a stand, generally designated 85, together with longitudinally spaced apertures 87 and 88 in transverse central relationship in the bottom wall. The apertures 87 and 88 open to cavities 89 and 90 respectively that are defined by bottom wall bubbles 91 and 92 and, together with the adjacent generally planar bottom wall portions and/or perimetric wall 37, provide stand pockets. Advantageously, the stand may include a pair of elongated legs 94 that are pivotally connected by a hinge 95. One end of a link 97 is pivotally connected to each leg remote from the hinge by a pivot 98 while the opposite ends of the links are pivotally connected by a pivot bracket 99 that is somewhat Y-shaped. The pivot axes of the pivotal connections of the links to legs and to each other and of the hinge are parallel to one another whereby the legs can be pivoted between a folded condition of FIG. 1 and a support position of FIG. 10 wherein the legs diverge from one another.

Latch mechanism M is provided for releasably retaining the inner case in a closed condition. The latch mechanism M may be of a conventional type such as illustrated in FIG. 13 wherein the latch bail 21 is being moved to an inner case latched condition. The inner case walls, including the bubbles 74, 91, 92 are imperforated (other than for the mounting of the valves 44, 54 and the vacuum gauge 53 which are mounted in fluid sealing relationship to wall 37A) whereby, when the cover is in a latched condition and/or the inner case interior is vacuumized, the inner case is air tight. Further, conventional lock mechanism 31 may be mounted to the inner case for retaining it in a locked condition.

The stand also includes an elongated arm 100 having one end mounted to the pivot bracket 99 to pivot about an axis that extend 90 degrees relative to the pivot axis of the adjacent ends of the links 97. The opposite end of the arm mounts one end portion of a rod 101 in a suitable manner to pivot about an axis coextensive with or parallel to the axis of elongation of the arm while retaining the rod in a fixed axial position relative to the arm. The opposite end of the rod mounts a rectangular block 102 to pivot therewith. The block is of a smaller length than the length of the aperture 88 but larger than the width of the aperture. Further, the block is of a width smaller than the width of the aperture. As a result, the block may be extended through the aperture 88 to be within the cavity 90 and then, by rotating the rod about 90 degrees, the block retained in the cavity until again rotated about 90 degrees. The block in the cavity together with the links and arm retain the bottom wall to extend at an inclined angle relative to the legs.

Figure 5:
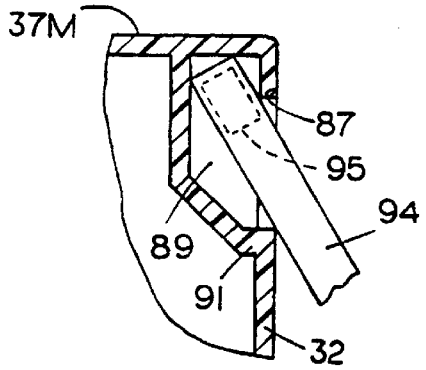
FIG. 5 is a fragmentary longitudinal cross section view of the top stand pocket with a portion of the stand extended thereinto, said view being generally taken along the line and in the direction of the arrows 5—5 of FIG. 3.
Figure 6:
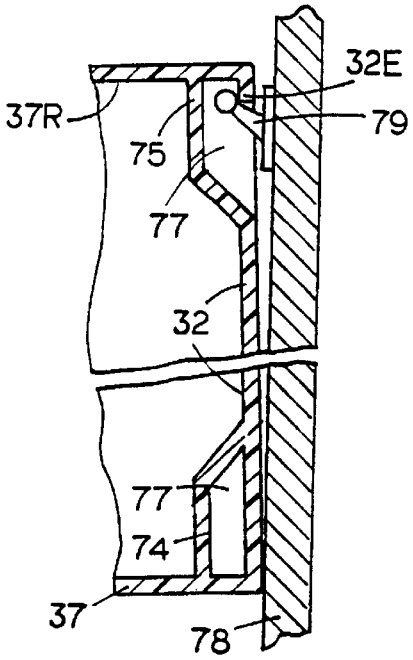
FIG. 6 is a fragmentary transverse cross sectional view of two of the hangar pockets with the inner case of the first embodiment hanging on the wall and an intermediate portion of the inner case broken away, said view being generally taken along the line and in the direction of the arrows 6—6 of FIG. 3.
Figure 7:
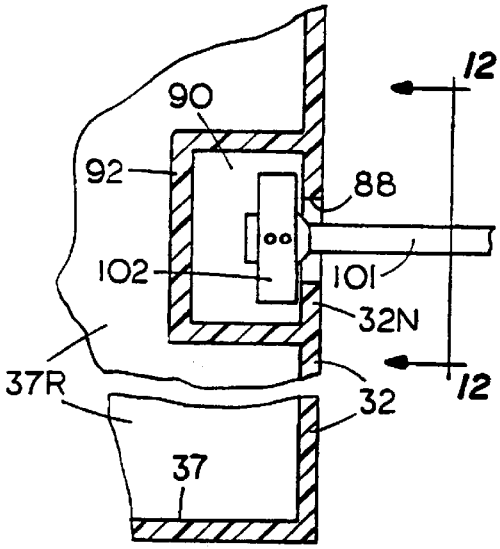
FIG. 7 is a fragmentary longitudinal cross sectional view of the bottom stand pocket of the inner case of the first embodiment with a portion of the stand extended thereinto and an intermediate portion broke away, said view being generally taken along the line and in the direction of the arrows 7—7 of FIG. 3.
Figure 8:
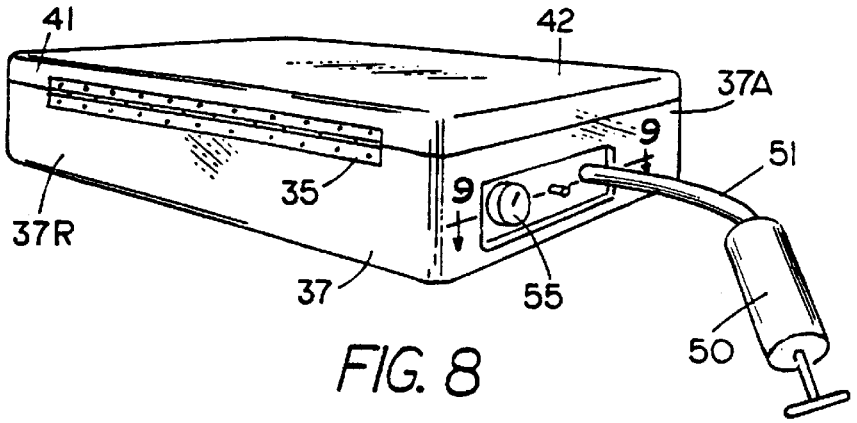
FIG. 8 is a perspective view of the inner case of the first embodiment in a closed condition with a vacuum pump connected thereto.
Figure 10:
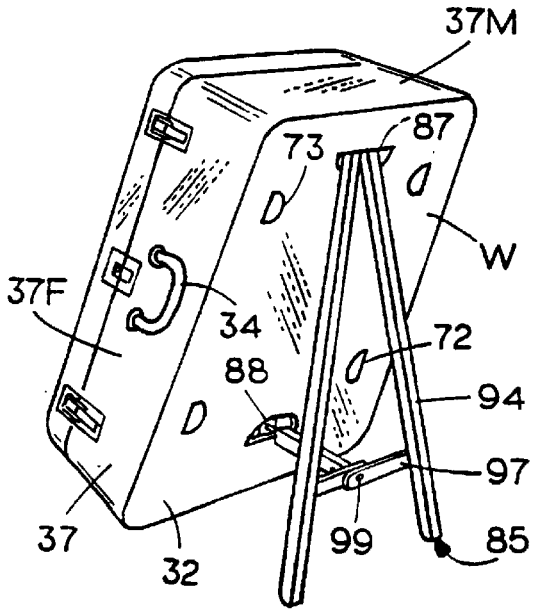
FIG. 10 is a perspective view of the inner case of the first embodiment being supported by the stand in a display condition.
Figure 11:
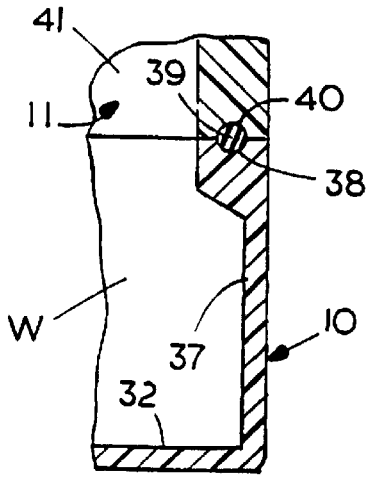
FIG. 11 is a fragmentary cross sectional view that is generally taken along the line and in the direction of the arrows 11—11 of FIG. 2 of the inner case of the first embodiment in a closed condition showing the mounting of the perimetric seal.
Figure 12:
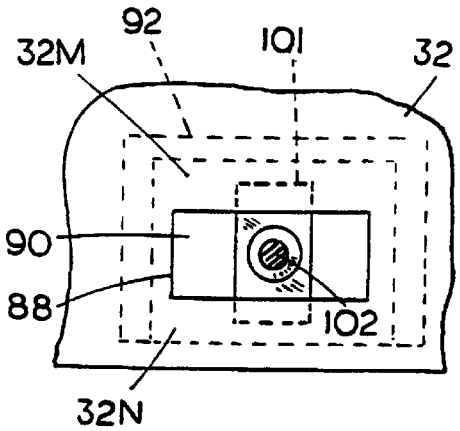
FIG. 12 is a fragmentary bottom view that is generally taken along the line and in the direction of the arrows 12—12 of FIG. 7 with a portion of the stand extended therein.

The cavity 89 and aperture 87 are sufficiently large to have the hinged portions of the legs 94 extended thereinto such as shown in FIGS. 5 and 10 with the legs and links pivoted to have the link pivots 98 at their maximum spacing and the rod 101 and block 102 extended into cavity 90 and than rotated to the FIG. 12 position of FIG. 10. However, with the legs 94 pivoted to have the link pivots 98 to have the link pivots 98 in their most closely adjacent position and the arm 100 pivoted to have the block 192 in its most closely adjacent position to the hinge, the stand, together with the suction pump, may be placed in the compartment 19 of the outer case.

The lengths of the rod 101, arm 100 and the links and the position of the pivot axes are such that with the block and hinged ends of the legs extended into the respective cavity, the inner case, including its bottom wall, is inclined at the desired angle to the floor or table on which the inner case is placed. With the inner case and only the musical instrument in the inner case, the instrument may be viewed from the sides, front and back without opening the inner case.

Referring to FIGS. 14 to 18, the inner case Z of the second embodiment includes an inner receptacle, generally designated 110, providing an interior compartment with a cover, generally designated 111, connected thereto by hinges 115 for closing the inner receptacle compartment. The receptacle 110 has a perimetric wall 112 joined to the outer peripheral edge of the bottom wall 117 to extend thereabove while the cover has a perimetric wall 113 joined to the cover top wall 114 to extend downwardly therefrom. At least of the perimetric walls 112 and 113 has a perimetric groove mounting a fluid seal member (gasket) 118 to form a fluid seal therebetween when the cover is in a closed position. The cover 111 and receptacle 110 are provided with latch mechanism (not shown) and the receptacle 110 with a handle (not shown) such as disclosed with reference to the first embodiment.

Figure 14:
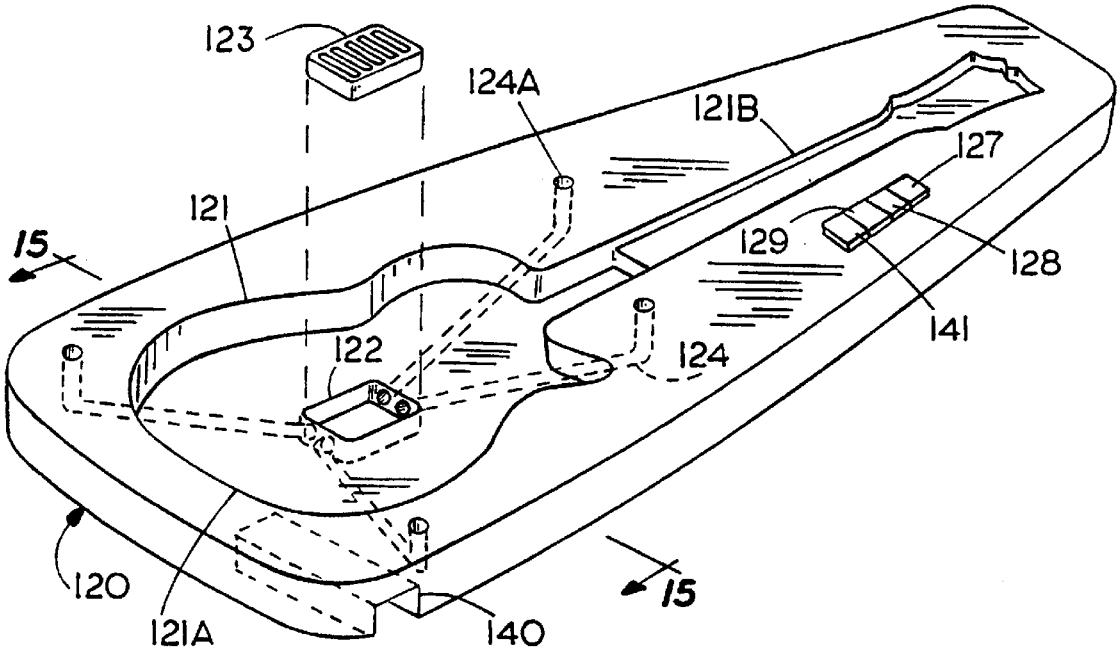
FIG. 14 is a perspective view of the foam pad or insert of the second embodiment of the invention with the desiccant in an exploded condition relationship thereto with the instrument hold-down mechanism not being shown.
Figure 15:
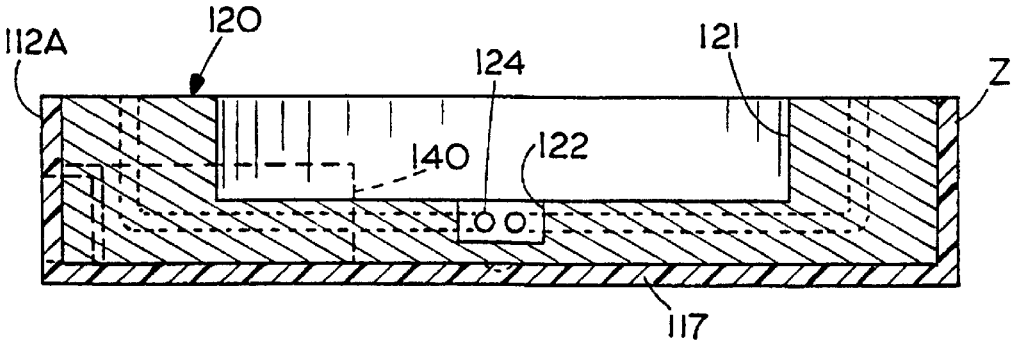
FIG. 15 is a transverse cross sectional view of the second embodiment of the invention with the foam insert in the receptacle of the inner case of the second embodiment, said view being generally taken along the line and in the direction of the arrows 15—15 of FIG. 14, other than the cover, latch mechanism and the perimetric seal are not shown.
Figure 16:
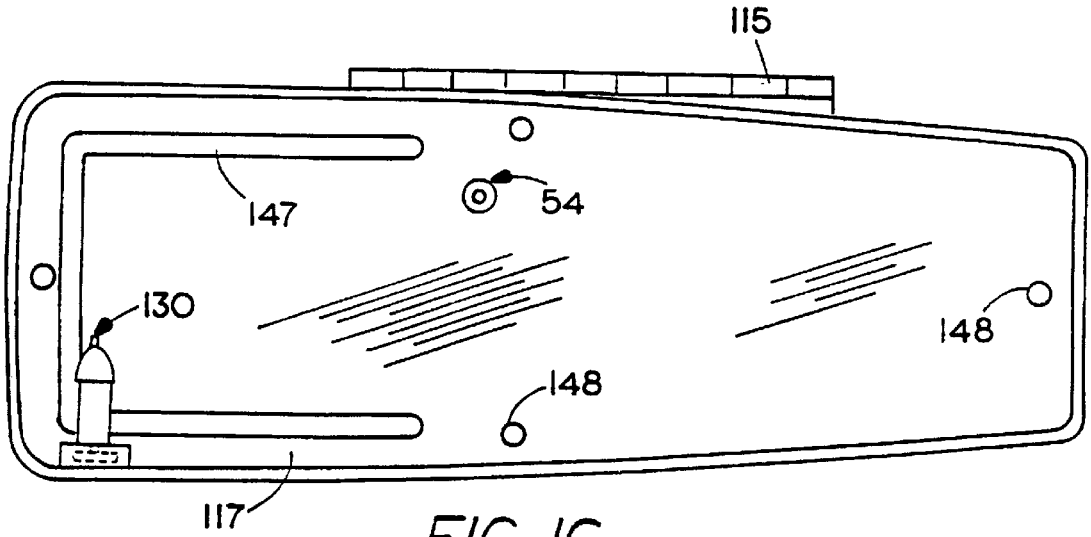
FIG. 16 is a top view of the empty receptacle of the inner case of the second embodiment with a vacuum pump attached thereto.
Figure 17:
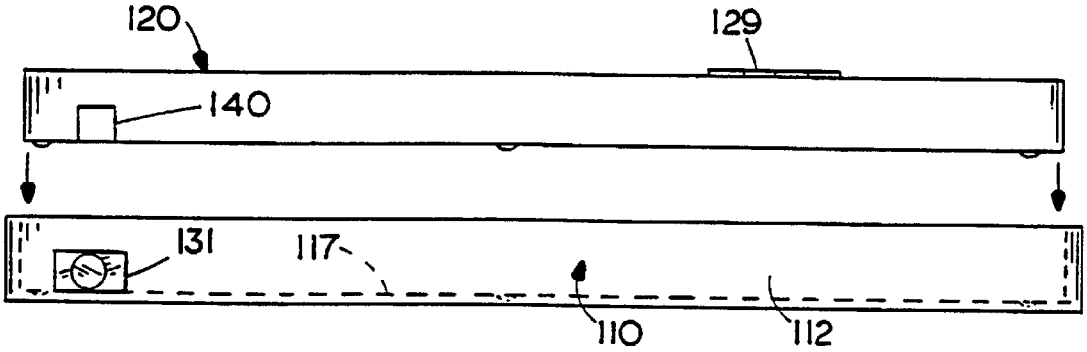
FIG. 17 is side view of the receptacle of the inner case of the second embodiment with the foam insert thereabove.
Figure 18:
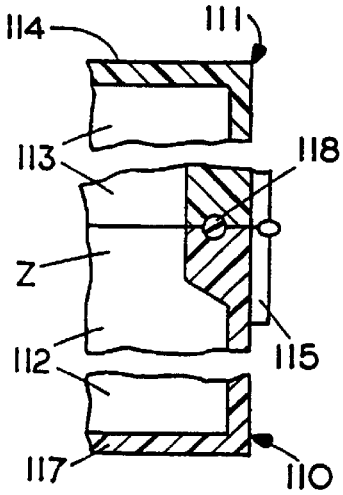
FIG. 18 is a fragmentary cross sectional view of the inner case of the second embodiment showing the fluid seal and the cover hingedly connected to the receptacle in a closed condition.
Figure 20:
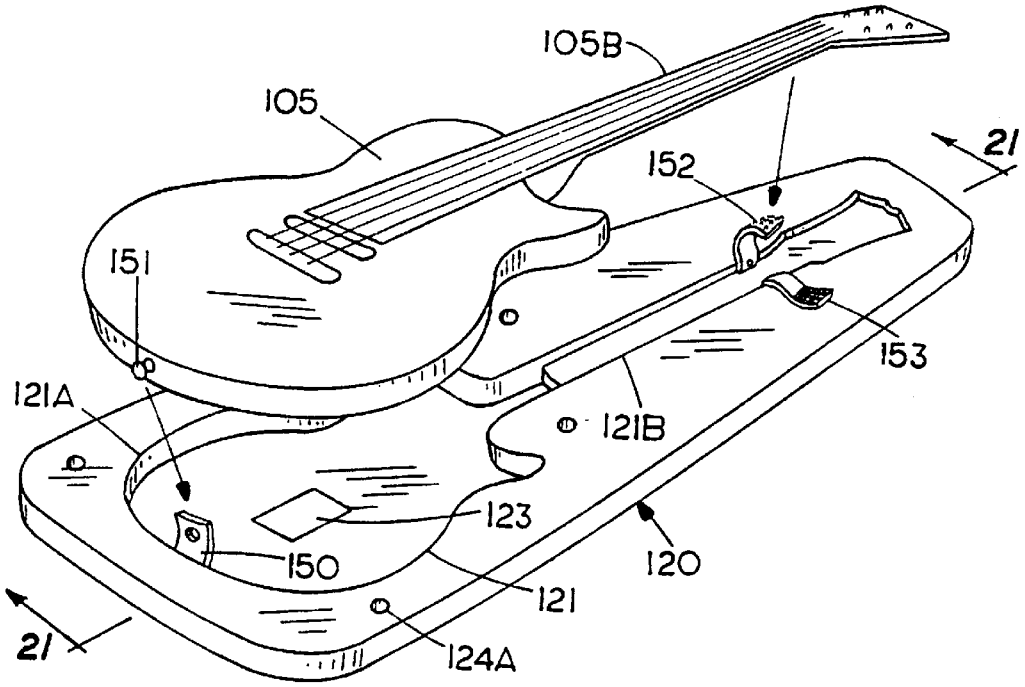
FIG. 20 is a perspective view of the insert of the second embodiment with the guitar to be inserted in the chamber thereof thereabove and the sensors not being shown.
Figure 21:
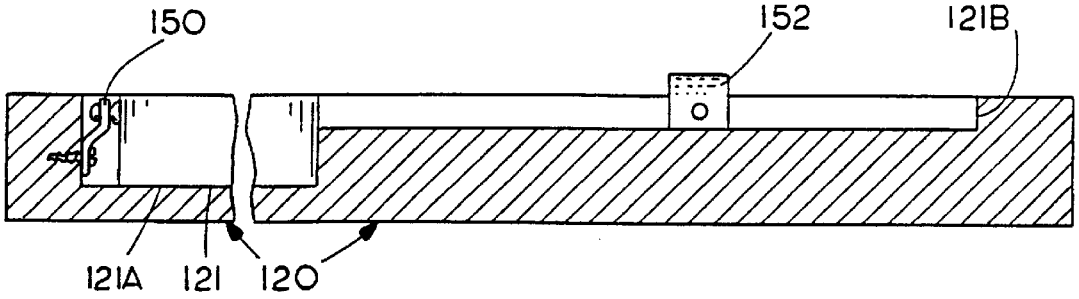
FIG. 21 is a longitudinal cross sectional view of the insert that is generally taken along the line and in the direction of the arrows 21—21 of FIG. 20.

Advantageously, a plastic foam insert (cushion), generally designated 120, is provided in the receptacle compartment to substantially fill the compartment other than for the features set forth hereinafter, but is readily removable for being replaced with another foam insert. The foam insert has an upwardly opening main chamber 121 which may be of a general shape as the item to be stored therein, for example a guitar as shown in FIGS. 14 and 20. A desiccant chamber 122 for containing a desiccant 123 opens to the main chamber. A plurality of fluid passages 124 are provided in the foam insert to open to the desiccant compartment and through the top surface of the insert in spaced relation to the chamber 122 at 124A on longitudinal and transverse opposite sides of the guitar main body chamber part 121A to more evenly withdraw moisture from the various part of the inner case. Also, an upwardly opening compartment may be provided in the insert to mount sensors 127, 128 and 129 for respectively sensing the vacuum pressure, humidity and temperature. Advantageously, a conventional motion sensor alarm 141 is provided in the compartment adjacent to the sensors 127–129. The alarm may be selectively actuated and deactuated by a conventional infrared remote (not shown) even when the inner case is in a closed vacuumized condition.

To hold the musical instrument in place within the closed inner case, even if the inner case is turn with its bottom wall above the cover, there is provided hold down mechanism that includes an elastic strap 150 having one end attached to the insert adjacent to the bottom of the chamber 121 at the end thereof longitudinally opposite the chamber neck portion 121B and in transverse centered relationship. The opposite end of the strap has an aperture through which the instrument botton 151 extends. The strap is of a length and resiliency to permit the guitar being moved to have the button extended through the strap aperture and then the strap to elastically contract to hold the adjacent end of the instrument in abutting relationship to the bottom of the chamber portion 121A. On opposite transverse sides of the chamber neck portion 121B there is respectively mounted the one ends of strip hook and loop fastener members (for example such as sold under the trademark Velcro) 152 and 153. After the strap 150 has been attached to button 151 and with the guitar laying flat in the insert chamber 121, the hook and fastener members are folded over the guitar neck 105B in a fastened relationship to one another.

The foam insert in the inner case may be readily replaced with another foam insert with a main chamber therein of a different size and/or shape to facilitate storing an item in the inner case that is of a different size and/or shape than the item meant to be stored in or was stored in the insert chamber that was removed from the inner case. The particular insert provided in the inner case, desirably has the main chamber that in plan view is of a shape that generally is of same size and shape as the item to be stored therein when viewed in plan with sufficient clearance between the perimetric side walls defining the main chamber to facilitate placing in and removing the item from the chamber. Advantageously, the depth of the main chamber is of a dimension that is about the same as the corresponding dimension of the main portion of the item to be stored therein. With the insert having such a main chamber, movement of the stored item relative to the inner case, if any, is minimized while at the same time permitting seeing the item when the inner case is in a closed vacuumized condition.

For withdrawing fluid from the interior of the closed inner case of the second embodiment, a vacuum pump, generally designated 130, is mounted to the receptacle perimetric wall portion 112A of the part of the receptacle 110 that in part defines a receptacle recess 131. The pump has a cylinder cap 132 removably mounted to the wall portion 112A in fluid sealing relationship to mount the pump cylinder 133 to extend into the interior of the receptacle 110 whereby there is no fluid leakage between the pump and the inner case. The cylinder mounts a nozzle member 134 to close the opposite end of the cylinder and mounts a valve ball 135 that is spring urged to block fluid flow into the interior of the receptacle but permit fluid being drawn thereinto. The foam insert has a cut out 140 that opens to the inner receptacle bottom wall and to wall portion 112A when the insert is in the inner receptacle to permit the insert being removed without removing the pump from the inner receptacle.

The pump 130 also includes a handle 137 connected to a piston 138 having conventional valving such that as the handle is pulled outwardly (arrow 139) fluid is drawn into the cylinder through the nozzle member and is expelled outwardly through apertures in the cylinder cap. When the handle is pushed in the opposite direction, the fluid between the piston and the nozzle member moves through the piston to the cap side thereof. The recess is of a depth that the handle does not extend outwardly of the recess as may be seen in FIG. 15.

Mounted to the bottom wall 117 for venting the inner case of the second embodiment is a vent valve 54 that advantageously is the same as that described with reference to the first embodiment.

Also mounted to the bottom wall 117 of the receptacle 110 is a generally U-shaped stand, generally designated 142. The stand has elongated legs 143 with their terminal ends connected to the longitudinally intermediate portion of the wall 117 by transverse pivot members 145 and their opposite ends joined to one another by web portion 144. The stand is pivotable between a storage position that the web portion abuts against the wall 117 and an inclined display position that the legs extend downwardly from the pivots at an angle relative to the bottom wall to have the bottom wall extend at an angle of, for example 45 to 75 degrees relative to the floor or table against which the web portion and inner receptacle abut.

Advantageously, the exterior surface portion of the bottom wall 117 has a U-shaped recess 147 into which the stand has at least part of the legs and web portion located when the stand is in the stand folded (storage) position. The bottom wall 117 has a plurality bubbles 148 to provide cavities 149 opening outwardly through the bottom wall in a manner similar to bubbles 74 and cavities 77 of the first embodiment to facilitate hanging the second embodiment of the inner case on a wall such as described with reference to the first embodiment.

Figure 19:
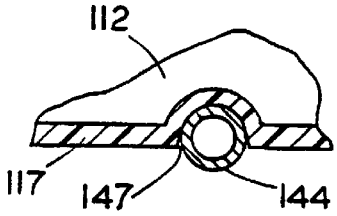
FIG. 19 is a fragmentary cross sectional view generally taken along the line and in the direction of the arrows 19—19 of FIG. 24 with the stand in its storage position.
Figure 26:
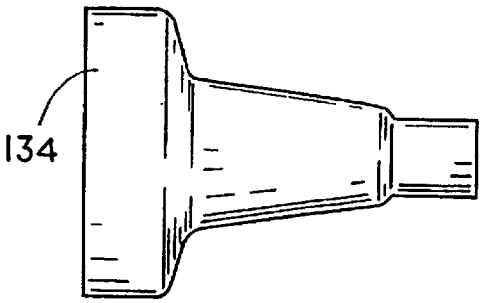
FIG. 26 is a showing of the nozzle of pump of FIG. 19.
Figure 25:
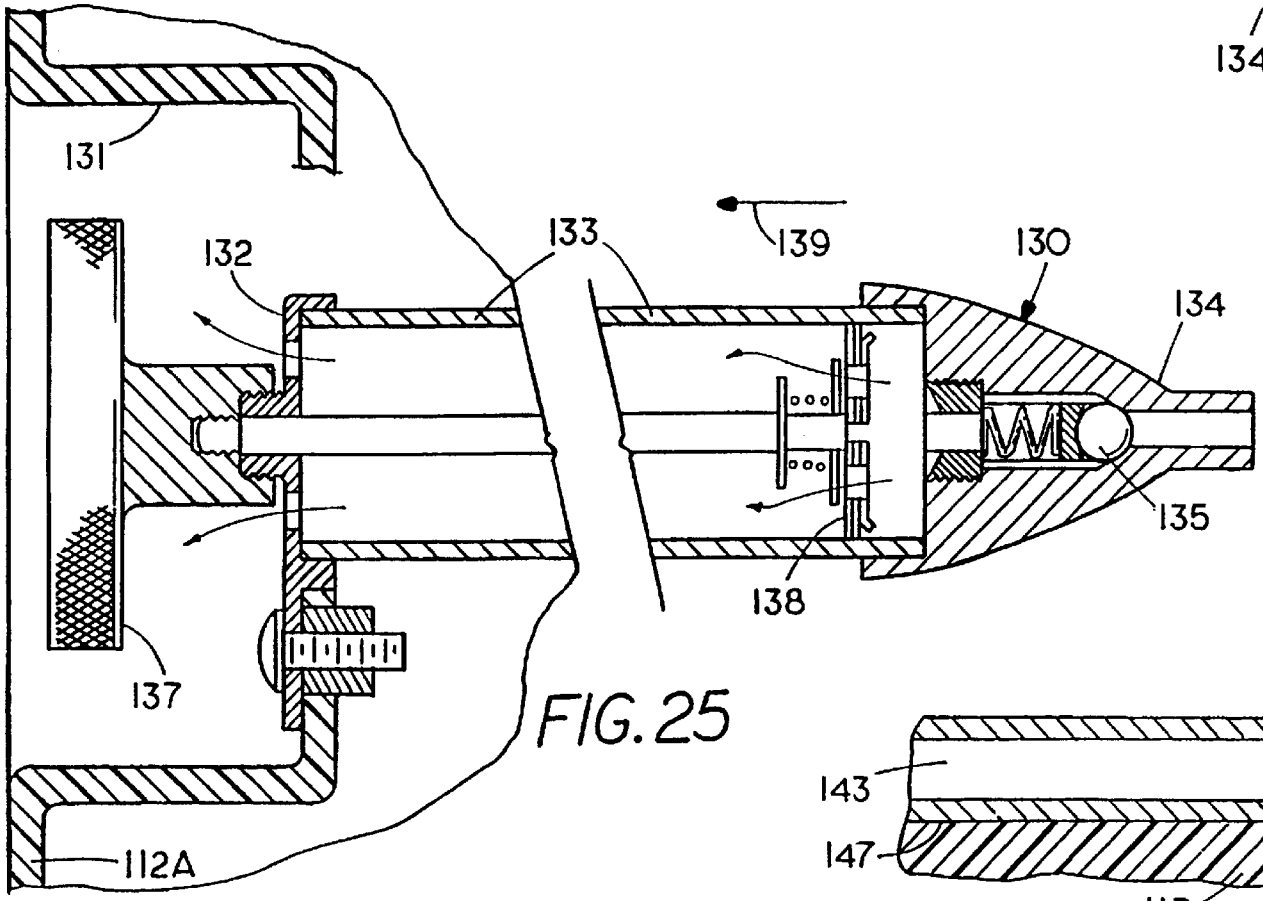
FIG. 25 is a fragmentary cross sectional view showing a vacuum pump mounted to a perimetric wall of the inner receptacle of the second embodiment.
Figure 27:
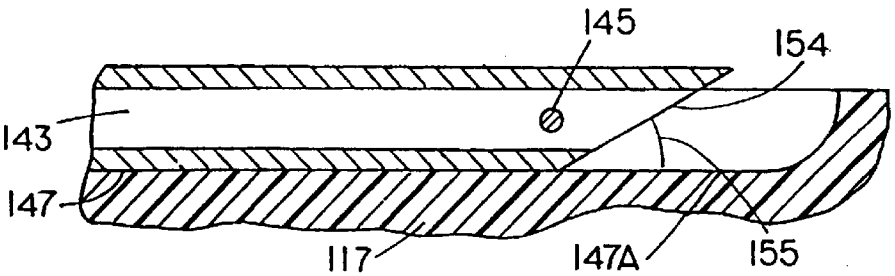
FIG. 27 is a fragmentary cross sectional view through the pivotal connection of the stand to the bottom wall of the inner case of the second embodiment.

As one manner of limiting the pivotal movement of the stand relative to the bottom wall 117, the free terminal ends of the stand legs, in the stand folded position of FIG. 26, may be cut or sloped to be in a plane at an angle 155 relative to the planar portions of the bottom wall (other than for the bubbles and recess 147) to provide the legs with free terminal planar edges 154 that are abuttable against the planar surface portions 147A of the recess 147 in the stand display position. The leg end surfaces 154 in abutting against the planar surfaces 147A limit the pivotal movement of the stand from the folded position of FIG. 26 to a display position. Thus, when the stand is pivoted from the folded position of FIGS. 19 and 26 through angle 155, the bottom wall 117 will extend at an acute angle relative to the floor.

Figure 22:
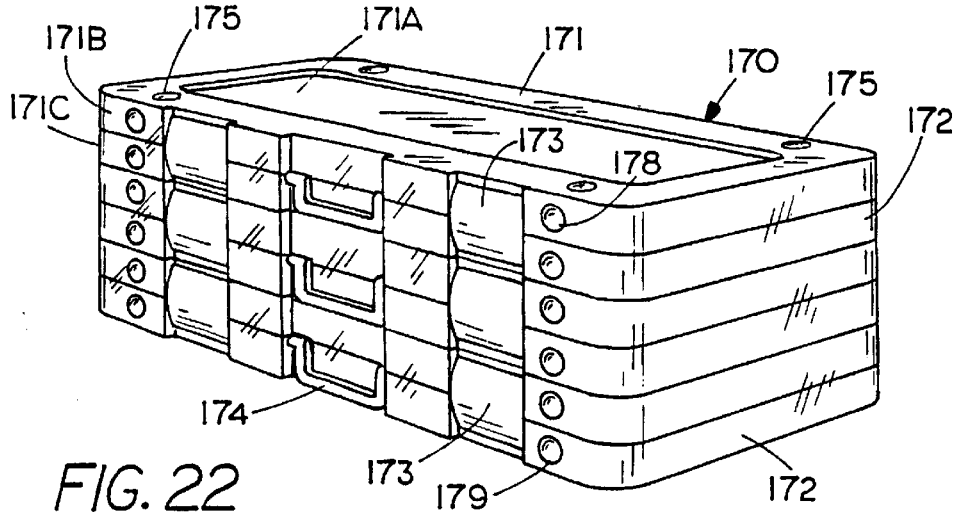
FIG. 22 is a stacked perspective view of outer cases of the second embodiment.
Figure 23:
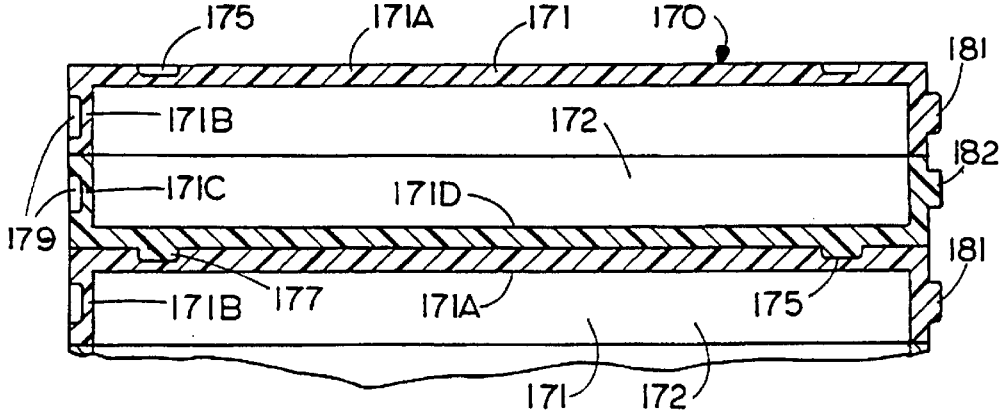
FIG. 23 is a fragmentary transverse cross sectional view of the stacked outer cases of FIG. 22.
Figure 24:
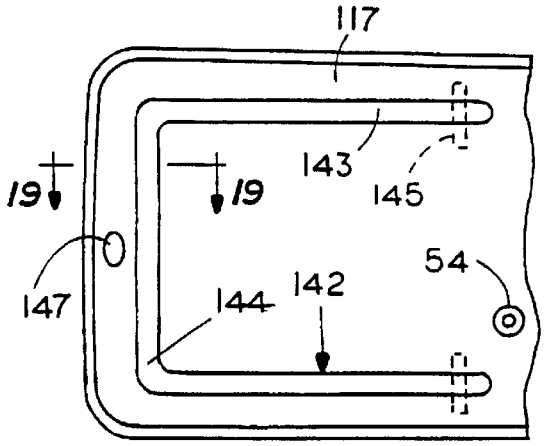
FIG. 24 is a fragmentary bottom view of the inner case of the second embodiment together with a stand that is connected thereto.

Referring to FIGS. 22 and 23, the outer case of the second embodiment, generally designated 170 is provided for having the inner case Z stored and carried therein. The outer case 170 includes a cover 171 hingedly connected to the outer receptacle 172 and conventional latch mechanism 173 for retaining the outer case in a closed condition. A handle 174 is mounted to the outer receptacle to facilitate carrying the outer case. Additionally, the top wall 171A at each corner portion includes an upwardly opening stacking recess 175 to snugly receive a stacking protrusion 177 joined to the bottom wall 171D of the outer receptacle of a second outer case that is stacked thereabove with the case top and bottom walls extending generally horizontally. Further, the front walls 171B and 171C of the outer cover and outer receptacle of one outer case respectively have corresponding stacking recesses 179 to have stacking protrusions 181 and 182 of the rear walls of the outer cover and outer receptacle of another outer case extend therein when stacked one above another with their bottom and top walls extending generally vertically. By providing the stacking protrusions and recesses, the outer cases may be stacked and will not tend to slide relative to one another when being transported.

The outer case of the second embodiment may or may not have cushioning material therein such as material 24 disclosed with reference to the first embodiment. Desirably, the interior compartment of the outer case of the second embodiment is of a size to have the inner case of the second embodiment stored therein with little relative movement together with suitable cushioning material in the outer case, if necessary to minimize relative movement. It is to be understood that the inner and outer cases may be of varying shapes, if desired for storing the items therein.

The inner case of each of the embodiments may be used for storing musical instruments or other items, for example a guitar 105, guns or other collectible items. Advantageously, suitable cushioning material 104 or 120 such as plastic foam of appropriate shape may be provided in the inner cases to protect the instrument or other item therein when the instrument is being transported from one location to another or when being stored, but may be removed when the case is being used as a display case. To protect the inner case, especially when being transported from one location to another and to have the stand and vacuum pump of the first embodiment readily available when at the second location, there is provided the outer case. If additional protection for the inner cases is desired, a vinyl or fabric bag (not shown) may be provided to contain the inner case in the outer case.

To reduce deterioration of the instrument being stored, the vacuum pump is utilized to reduce the air pressure in the inner case to the desired negative level, the gauge being provided so that the user can readily ascertain the pressure level in the inner container. The vent valve may be utilized to equalize the pressure inside and outside of the inner case when it is desired to open the inner case. By reducing the pressure level in the inner case, the instrument is subject to decreased effects from air and moisture than occur with known prior art portable cases of the type disclosed herein. Further, the reduced pressure enhances the sealing effects of the resilient seal to prevent ingress of fluid into the inner case. The lock may be utilized to prevent others from taking the instrument out of the inner case.

With the desiccant in the inner case and the inner case being vacuumized, moisture is gradually withdrawn from wooden instruments or wooden portions of the item stored in the inner case with the wood becoming more porous. With musical instruments that at least in part are made of wood, for example guitars, this results in the instrument becoming more resonate and having a better tone.

With the inner case cover in a close condition, it is noted that all of the above mentioned bubbles (protrusions) extend more closely adjacent to the cover than the surrounding, generally planar bottom wall portions and bottom wall lips.

The foam insert serves as a shock absorber to protect the item stored therein during transport while the outer case prevents scratching of the inner case and additional protection from impact damage during transport.

What is claimed is:

1. A portable carrying case for carrying, storing and displaying various items and selected from the groups consisting of a musical instruments including a guitar, guns and collectibles, comprising a receptacle made of a rigid plastic material and having an interior compartment for having the item located therein, a bottom wall and a perimetric wall joined to the bottom wall and having a terminal perimetric edge portion spaced from the bottom wall, a cover for closing the receptacle compartment, said cover having a perimetric portion, hinge means for connecting the cover to the perimetric wall for movement between an open condition and a closed condition with the cover perimetric portion closely adjacent to the receptacle perimetric edge portion, perimetric seal means mounted to one of the cover perimetric portion and the receptacle perimetric edge portion to cooperate with the other of the cover perimetric portion and the receptacle perimetric edge portion to form a fluid seal therebetween when the cover is in a closed condition and suction means mounted to one of the cover and the receptacle to facilitate evacuating fluid from the receptacle interior compartment when the cover is closed, characterized in that a handle is connected to one of the receptacle and cover to facilitate an individual carrying the case, the case with the item therein being of a weight for being carried by a single individual, the seal means with the cover in a closed condition providing an airtight case interior compartment for reducing deterioration of the item when the item is in the compartment and the compartment is at a negative pressure and plastic foam cushioning material is removably provided in the case, said material being of a shape to protect the item in the receptacle when being transported from one location to another, said cover being made of a clear rigid plastic to permit viewing the item in the receptacle interior compartment even when the cover is in its closed condition.

2. The portable carrying case of claim 1 wherein the receptacle has a wall portion mounting the suction means.

3. The portable carrying case of claim 1 wherein the suction means comprises a suction valve.

4. The portable carrying case of claim 1 wherein the suction means comprises a vacuum pump extending into the interior compartment.

5. The portable carrying case of claim 1 wherein the plastic cushioning material comprises a foam insert of a shape to substantially fill the receptacle interior compartment, the insert having a top surface and a first chamber opening through the top surface to have the item stored therein.

6. For carrying, storing and displaying musical instruments including a guitar, and collectible items, the combination of a generally box shaped case having an interior and support means for supporting the case in a display condition, the case including a receptacle having a storage compartment and a bottom wall, a cover for removably closing the receptacle, said cover and receptacle having adjacent perimetric edge portions, perimetric resilient seal means mounted to one of the perimetric edge portions for cooperating with the other of the perimetric edge portion to provide an airtight case interior when the cover is closed, suction means mounted to one of the cover and receptacle for withdrawing fluid from the case interior when the cover is closed, characterized in that the cover and receptacle are made of a rigid plastic, the cover being sufficiently clear to permit clearly observing the details of the one of the instrument and the collectible items stored in the storage compartment even when the cover is closed and the case interior has fluid evacuated therefrom, the bottom wall has a bubble providing an outwardly opening cavity and the support means comprises a hanger extendable into the cavity.

7. The combination of claim 6 wherein the case with the instrument therein is of a weight for being carried by a single individual and has a handle connected to the receptacle to facilitate being carried by an individual, and the support means includes a stand for supporting the case in an inclined condition relative to a floor or the like.

8. A portable carrying case for carrying, storing and displaying various items and selected from the groups consisting of a musical instruments including a guitar, guns and collectibles, comprising a receptacle made of a rigid plastic material and having an interior compartment for having the item located therein, a bottom wall and a perimetric wall joined to the bottom wall and having a terminal perimetric edge portion spaced from the bottom wall, the bottom wall having a bubble providing an outwardly opening cavity, a cover for closing the receptacle compartment, said cover being made of a rigid clear plastic material and having a perimetric portion, hinge means for connecting the cover to the perimetric wall for movement between an open condition and a closed condition with the cover perimetric portion closely adjacent to the receptacle perimetric edge portion, perimetric seal means mounted to one of the cover perimetric portion and the receptacle perimetric edge portion to cooperate with the other of the cover perimetric portion and the receptacle perimetric edge portion to form a fluid seal therebetween when the cover is in a closed condition, suction means mounted to one of the cover and the receptacle to facilitate evacuating fluid from the receptacle interior compartment when the cover is closed, a handle connected to one of the receptacle and cover to facilitate an individual carrying the case, the case with the item therein being of a weight for being carried by a single individual, the seal means with the cover in a closed condition providing an airtight case interior compartment with the item in the receptacle being viewable through the cover and deterioration of the item is reduced when the interior compartment is at a negative pressure, plastic foam cushioning material removably provided in the case, said material being of a shape to protect the item in the receptacle when being transported from one location to another, and support means for supporting the case in a display condition, the support means comprising a hanger extendable into the cavity.

9. A portable carrying case for carrying, storing and displaying various items and selected from the groups consisting of a musical instruments including a guitar, guns and collectibles, comprising a receptacle made of a rigid plastic material and having an interior compartment for having the item located therein, a bottom wall and a perimetric wall joined to the bottom wall and having a terminal perimetric edge portion spaced from the bottom wall, a cover for closing the receptacle compartment, said cover being made of a rigid clear plastic material and having a perimetric portion, hinge means for connecting the cover to the perimetric wall for movement between an open condition and a closed condition with the cover perimetric portion closely adjacent to the receptacle perimetric edge portion, perimetric seal means mounted to one of the cover perimetric portion and the receptacle perimetric edge portion to cooperate with the other of the cover perimetric portion and the receptacle perimetric edge portion to form a fluid seal therebetween when the cover is in a closed condition and suction means mounted to one of the cover and the receptacle to facilitate evacuating fluid from the receptacle interior compartment when the cover is closed, characterized in that a handle is connected to one of the receptacle and cover to facilitate an individual carrying the case, the case with the item therein being of a weight for being carried by a single individual, the seal means with the cover in a closed condition providing an airtight case interior compartment with the item in the receptacle being viewable through the cover and deterioration of the item is reduced when the interior compartment is at a negative pressure, plastic foam cushioning material is removably provided in the case, said material being of a shape to protect the item in the receptacle when being transported from one location to another, a vacuum gauge mounted to measure the pressure in the receptacle interior compartment when the cover is in its closed condition and a vent valve mounted to the receptacle to selectively allow air to flow into the receptacle when the cover is closed and the receptacle interior compartment is at a negative pressure.

10. A portable carrying case for carrying, storing and displaying various items and selected from the groups consisting of a musical instruments including a guitar, guns and collectibles, comprising an inner case having a receptacle made of a rigid plastic material and having an interior compartment for having the item located therein, a bottom wall and a perimetric wall joined to the bottom wall and having a terminal perimetric edge portion spaced from the bottom wall, a cover for closing the receptacle compartment, said cover being made of a rigid clear plastic material and having a perimetric portion, hinge means for connecting the cover to the perimetric wall for movement between an open condition and a closed condition with the cover perimetric portion closely adjacent to the receptacle perimetric edge portion, perimetric seal means mounted to one of the cover perimetric portion and the receptacle perimetric edge portion to cooperate with the other of the cover perimetric portion and the receptacle perimetric edge portion to form a fluid seal therebetween when the cover is in a closed condition and suction means mounted to one of the cover and the receptacle to facilitate evacuating fluid from the receptacle interior compartment when the cover is closed, characterized in that a handle is connected to one of the receptacle and cover to facilitate an individual carrying the case, the case with the item therein being of a weight for being carried by a single individual, the seal means with the cover in a closed condition providing an airtight case interior compartment with the item in the receptacle being viewable through the cover and deterioration of the item is reduced when the interior compartment is at a negative pressure, plastic foam cushioning material is removably provided in the case, said material being of a shape to protect the item in the receptacle when being transported from one location to another, the suction means comprises a suction valve and a hand operated vacuum pump fluidly connectable to the suction valve for evacuating fluid from the inner case, the case having a first and a second bubble that provide a first and a second outwardly opening cavity in spaced relationship to one another, a stand for the inner case that includes a pair of legs having one ends extendable into one bubble cavity, hinge means for connecting the leg one ends to permit the legs being hingedly moved between a folded storage position and a diverging case supporting position and arm linkage means movable between a folded storage position and a position extending into the other bubble cavity, and an outer case having a first compartment for containing the inner case and a second compartment for containing the vacuum pump and the stand when the legs and the linkage means are in their storage position.

11. A portable carrying case for carrying, storing and displaying various items and selected from the groups consisting of a musical instruments including a guitar, guns and collectibles, comprising a receptacle made of a rigid plastic material and having an interior compartment for having the item located therein, a bottom wall having a bubble providing an outwardly opening cavity and a perimetric wall joined to the bottom wall and having a terminal perimetric edge portion spaced from the bottom wall, a cover for closing the receptacle compartment, said cover being made of a rigid clear plastic material and having a perimetric portion, hinge means for connecting the cover to the perimetric wall for movement between an open condition and a closed condition with the cover perimetric portion closely adjacent to the receptacle perimetric edge portion, perimetric seal means mounted to one of the cover perimetric portion and the receptacle perimetric edge portion to cooperate with the other of the cover perimetric portion and the receptacle perimetric edge portion to form a fluid seal therebetween when the cover is in a closed condition, suction means mounted to one of the cover and the receptacle to facilitate evacuating fluid from the receptacle interior compartment when the cover is closed, a handle connected to one of the receptacle and cover to facilitate an individual carrying the case, the case with the item therein being of a weight for being carried by a single individual, the seal means with the cover in a closed condition providing an airtight case interior compartment with the item in the receptacle being viewable through the cover and deterioration of the item is reduced when the interior compartment is at a negative pressure, plastic foam cushioning material removably provided in the case, said material being of a shape to protect the item in the receptacle when being transported from one location to another, and support means for supporting the case in a display condition, the support means comprising a hanger extendable into the cavity and a stand, the stand and the case bottom wall having cooperating means for mounting the stand to the bottom wall for supporting the bottom wall in an inclined condition relative to a floor with the receptacle in abutting relationship to the floor.

12. A portable carrying case for carrying, storing and displaying various items and selected from the groups consisting of a musical instruments including a guitar, guns and collectibles, comprising a receptacle made of a rigid plastic material and having an interior compartment for having the item located therein, a bottom wall and a perimetric wall joined to the bottom wall and having a terminal perimetric edge portion spaced from the bottom wall, a cover for closing the receptacle compartment, said cover being made of a rigid clear plastic material and having a perimetric portion, hinge means for connecting the cover to the perimetric wall for movement between an open condition and a closed condition with the cover perimetric portion closely adjacent to the receptacle perimetric edge portion, perimetric seal means mounted to one of the cover perimetric portion and the receptacle perimetric edge portion to cooperate with the other of the cover perimetric portion and the receptacle perimetric edge portion to form a fluid seal therebetween when the cover is in a closed condition and suction means mounted to one of the cover and the receptacle to facilitate evacuating fluid from the receptacle interior compartment when the cover is closed, the suction means comprising a vacuum pump extending into the interior compartment, characterized in that a handle is connected to one of the receptacle and cover to facilitate an individual carrying the case, the case with the item therein being of a weight for being carried by a single individual, the seal means with the cover in a closed condition providing an airtight case interior compartment with the item in the receptacle being viewable through the cover and deterioration of the item is reduced when the interior compartment is at a negative pressure and plastic foam cushioning material is removably provided in the case, said material being of a shape to protect the item in the receptacle when being transported from one location to another, the foam cushioning material comprising a foam insert in the receptacle interior compartment that substantially fills the receptacle interior compartment and has a hollowed out chamber for having the item nested therein and a cut out opening to the bottom wall and the perimetric wall to have the pump extend thereinto between the bottom wall and the insert.

13. A portable carrying case for carrying, storing and displaying various items and selected from the groups consisting of a musical instruments including a guitar, guns and collectibles, comprising a receptacle made of a rigid plastic material and having an interior compartment for having the item located therein, a bottom wall and a perimetric wall joined to the bottom wall and having a terminal perimetric edge portion spaced from the bottom wall, a cover for closing the receptacle compartment, said cover being made of a rigid clear plastic material and having a perimetric portion, hinge means for connecting the cover to the perimetric wall for movement between an open condition and a closed condition with the cover perimetric portion closely adjacent to the receptacle perimetric edge portion, perimetric seal means mounted to one of the cover perimetric portion and the receptacle perimetric edge portion to cooperate with the other of the cover perimetric portion and the receptacle perimetric edge portion to form a fluid seal therebetween when the cover is in a closed condition and suction means mounted to one of the cover and the receptacle to facilitate evacuating fluid from the receptacle interior compartment when the cover is closed, characterized in that a handle is connected to one of the receptacle and cover to facilitate an individual carrying the case, the case with the item therein being of a weight for being carried by a single individual, the seal means with the cover in a closed condition providing an airtight case interior compartment with the item in the receptacle being viewable through the cover and deterioration of the item is reduced when the interior compartment is at a negative pressure and plastic foam cushioning material is removably provided in the case, said material being of a shape to protect the item in the receptacle when being transported from one location to another, the plastic cushioning material comprises a foam insert of a shape to substantially fill the receptacle interior compartment, the insert having a top surface, a first chamber opening through the top surface to have the item stored therein, a bottom surface, a desiccant chamber adjacent to the bottom surface and a plurality of fluid passages opening to the desiccant chamber and to the top surface in longitudinal spaced relationship to one another and in spaced relationship to the first chamber.

14. The portable carrying case of claim 13 wherein the stand includes a pair of legs having terminal end portions and the cooperating means comprises the leg terminal end portions and pivot means for connecting the terminal end portions to the bottom wall.

15. A portable carrying case for carrying, storing and displaying various items and selected from the groups consisting of a musical instruments including a guitar, guns and collectibles, comprising a receptacle made of a rigid plastic material and having an interior compartment for having the item located therein, a bottom wall and a perimetric wall joined to the bottom wall and having a terminal perimetric edge portion spaced from the bottom wall, a cover for closing the receptacle compartment, said cover being made of a rigid clear plastic material and having a perimetric portion, hinge means for connecting the cover to the perimetric wall for movement between an open condition and a closed condition with the cover perimetric portion closely adjacent to the receptacle perimetric edge portion, perimetric seal means mounted to one of the cover perimetric portion and the receptacle perimetric edge portion to cooperate with the other of the cover perimetric portion and the receptacle perimetric edge portion to form a fluid seal therebetween when the cover is in a closed condition and suction means mounted to one of the cover and the receptacle to facilitate evacuating fluid from the receptacle interior compartment when the cover is closed, characterized in that a handle is connected to one of the receptacle and cover to facilitate an individual carrying the case, the case with the item therein being of a weight for being carried by a single individual, the seal means with the cover in a closed condition providing an airtight case interior compartment with the item in the receptacle being viewable through the cover and deterioration of the item is reduced when the interior compartment is at a negative pressure and plastic foam cushioning material is removably provided in the case, said material being of a shape to protect the item in the receptacle when being transported from one location to another, the plastic cushioning material comprising a foam insert of a shape to substantially fill the receptacle interior compartment, the insert having a top surface and a first chamber opening through the top surface to have the item stored therein, the item to be stored being a musical instrument having a longitudinally elongated neck portion and a main body of a substantially greater transverse dimension than the corresponding dimension of the neck portion and having the neck portion joined thereto and a fastener member is attached to the main body longitudinally opposite the neck portion, the first chamber having a main body chamber part and a neck part opening to the main body chamber part, and hold down means is joined to the insert for releasably retaining the musical instrument in the first chamber, the hold down means including fastener means joined to the insert adjacent to the neck part for retaining the neck portion in the chamber neck part and strap means for securing the fastener member to the insert when the main body is in main body chamber.

16. A portable carrying case for carrying, storing and displaying various items and selected from the groups consisting of a musical instruments including a guitar, guns and collectibles, comprising a receptacle made of a rigid plastic material and having an interior compartment for having the item located therein, a bottom wall and a perimetric wall joined to the bottom wall and having a terminal perimetric edge portion spaced from the bottom wall, a cover for closing the receptacle compartment, said cover being made of a rigid clear plastic material and having a perimetric portion, hinge means for connecting the cover to the perimetric wall for movement between an open condition and a closed condition with the cover perimetric portion closely adjacent to the receptacle perimetric edge portion, perimetric seal means mounted to one of the cover perimetric portion and the receptacle perimetric edge portion to cooperate with the other of the cover perimetric portion and the receptacle perimetric edge portion to form a fluid seal therebetween when the cover is in a closed condition and suction means mounted to one of the cover and the receptacle to facilitate evacuating fluid from the receptacle interior compartment when the cover is closed, characterized in that a handle is connected to one of the receptacle and the cover to facilitate an individual carrying the case, the case with the item therein being of a weight for being carried by a single individual, the seal means with the cover in a closed condition providing an airtight case interior compartment with the item in the receptacle being viewable through the cover and deterioration of the item is reduced when the interior compartment is at a negative pressure, plastic foam cushioning material is removably provided in the case, said material being of a shape to protect the item in the receptacle when being transported from one location to another, the plastic cushioning material comprising a foam insert of a shape to substantially fill the receptacle interior compartment, the insert having a top surface and a first chamber opening through the top surface to have the item stored therein and there is an outer case for containing the inner receptacle with the cover in a closed condition, the outer case having an exterior surface, a wall having spaced stacking recesses and an opposite wall having stacking protrusions of a spacing and of a size to be extendable into the stacking recesses and a handle connected to the outer case to facilitate the carrying of the outer case by an individual.

17. A portable carrying case for carrying, storing and displaying various items and selected from the groups consisting of a musical instruments including a guitar, guns and collectibles, comprising a receptacle made of a rigid plastic material and having an interior compartment for having the item located therein, a bottom wall and a perimetric wall joined to the bottom wall and having a terminal perimetric edge portion spaced from the bottom wall, a cover for closing the receptacle compartment, said cover being made of a rigid clear plastic material and having a perimetric portion, hinge means for connecting the cover to the perimetric wall for movement between an open condition and a closed condition with the cover perimetric portion closely adjacent to the receptacle perimetric edge portion, perimetric seal means mounted to one of the cover perimetric portion and the receptacle perimetric edge portion to cooperate with the other of the cover perimetric portion and the receptacle perimetric edge portion to form a fluid seal therebetween when the cover is in a closed condition and suction means mounted to one of the cover and the receptacle to facilitate evacuating fluid from the receptacle interior compartment when the cover is closed, characterized in that a handle is connected to one of the receptacle and the cover to facilitate an individual carrying the case, the case with the item therein being of a weight for being carried by a single individual, the seal means with the cover in a closed condition providing an airtight case interior compartment with the item in the receptacle being viewable through the cover and deterioration of the item is reduced when the interior compartment is at a negative pressure, plastic foam cushioning material is removably provided in the case, said material being of a shape to protect the item in the receptacle when being transported from one location to another, the plastic cushioning material comprising a foam insert of a shape to substantially fill the receptacle interior compartment, the insert having a top surface and a first chamber opening through the top surface to have the item stored therein and a desiccant, motion sensing alarm and temperature, humidity and pressure sensors are provided in the case.

18. A portable carrying case for carrying, storing and displaying various items including musical instruments, guns and collectibles, comprising a receptacle made of a rigid plastic material and having an interior compartment for having the item located therein, an imperforated bottom wall and a perimetric wall joined to the bottom wall and having a terminal perimetric edge portion spaced from the bottom wall, the bottom wall having a bubble providing a hanger pocket opening outwardly of the interior compartment, closure means for closing the interior compartment, the closure means having a perimetric portion and being movably relative to the receptacle between an open condition and a closed condition with the closure mean perimetric portion closely adjacent to the receptacle perimetric edge portion to close the interior compartment, perimetric seal means mounted to one of the closure means perimetric portion and the receptacle perimetric edge portion to cooperate with the other of the closure means perimetric portion and the receptacle perimetric edge portion to form a fluid seal therebetween when the closure means is in a closed condition and provide an airtight interior compartment, and suction means mounted to one of the closure means and the receptacle to facilitate evacuating fluid from the receptacle interior compartment when the closure means is in a closed condition, the closure means being made of a rigid plastic that is sufficiently clear to permit clearly observing the details of the item located in the interior compartment even when the closure means is in a closed condition and fluid is evacuated from the interior compartment.

* * * * *